US008967419B2

(12) United States Patent
Gerber et al.

(10) Patent No.: US 8,967,419 B2
(45) Date of Patent: Mar. 3, 2015

(54) PORTABLE COOLER DEVICE

(71) Applicants: Scott Dennis Gerber, Ham Lake, MN (US); Karla Gerber, Ham Lake, MN (US)

(72) Inventors: Scott Dennis Gerber, Ham Lake, MN (US); Karla Gerber, Ham Lake, MN (US)

( * ) Notice: Subject to any disclaimer, the term of this patent is extended or adjusted under 35 U.S.C. 154(b) by 0 days.

(21) Appl. No.: 13/950,185

(22) Filed: Jul. 24, 2013

(65) Prior Publication Data

US 2014/0027461 A1 Jan. 30, 2014

Related U.S. Application Data

(60) Provisional application No. 61/676,743, filed on Jul. 27, 2012.

(51) Int. Cl.

*F25D 31/00* (2006.01)
*F25D 3/08* (2006.01)
*B65D 25/16* (2006.01)

(52) U.S. Cl.

CPC ..... *F25D 31/00* (2013.01); *F25D 2331/804* (2013.01); *F25D 3/08* (2013.01); *B65D 25/16* (2013.01)
USPC ..... 220/592.2

(58) Field of Classification Search

CPC ..... F25D 3/08; F25D 3/06; F25D 2331/804; A45C 11/20; B65D 25/16; B65D 25/14; B65D 81/3834; B65D 81/3827; B65D 81/3825; B65D 81/38; B65D 85/50
USPC ..... 220/592.26, 592.2, 915.2, 915.1, 775, 220/773, 769, 760, 759, 324, 315, 657, 220/656; 62/457.7, 457.4, 457.5, 457.2, 62/457.1; 383/202; 229/204; 43/54.1
See application file for complete search history.

(56) References Cited

U.S. PATENT DOCUMENTS

| | | | | | |
|---|---|---|---|---|---|
| 968,971 | A | * | 8/1910 | Peck | 220/592.14 |
| 1,018,041 | A | * | 2/1912 | Evensen | 220/592.26 |
| 1,229,912 | A | * | 6/1917 | Doncaster | 220/592.23 |
| 2,647,653 | A | * | 8/1953 | Dube | 220/592.2 |
| 4,651,538 | A | | 3/1987 | Bull et al. | |
| 4,793,149 | A | * | 12/1988 | Riche | 62/293 |
| 4,802,344 | A | * | 2/1989 | Livingston et al. | 62/372 |
| 4,877,128 | A | * | 10/1989 | Strickland | 206/170 |
| 4,981,234 | A | | 1/1991 | Slaughter | |
| 5,050,387 | A | | 9/1991 | Bruce | |
| 5,050,766 | A | | 9/1991 | Groh | |
| 5,216,900 | A | | 6/1993 | Jones | |
| 5,231,850 | A | | 8/1993 | Morris | |
| 5,275,015 | A | | 1/1994 | Brossia et al. | |
| 5,570,588 | A | | 11/1996 | Lowe | |
| 5,701,757 | A | | 12/1997 | Heverly | |
| 6,427,475 | B1 | | 8/2002 | DeFelice et al. | |
| 7,040,115 | B1 | | 5/2006 | Lopez et al. | |

* cited by examiner

*Primary Examiner* — Robert J Hicks

(57) ABSTRACT

A portable cooler device. The portable cooler device may include an exterior shell, an insulated container surrounded by the exterior shell and at least one cooling insert held by the insulated container. A liner that may have a cooling chamber may be placed within the interior housing of the at least one cooling insert. A cover may be included so that the contents of the cooling chamber may stay cool. A carrying handle may hold the cover in place and allow for transport.

11 Claims, 7 Drawing Sheets

Final Equation in Terms of Actual Factors:

| | |
|---|---|
| Time | = |
| +885.70647 | |
| -928.97989 | * Foam |
| -2.16045 | * Gel |
| -6846.98276 | * Liner |
| +4.10560 | * Foam * Gel |
| +7614.94253 | * Foam * Liner |
| +19.28879 | * Gel * Liner |
| -21.55172 | * Foam * Gel * Liner |

FIG. 6

PORTABLE COOLER DEVICE

CROSS-REFERENCE TO RELATED APPLICATION

This application claims the benefit of U.S. provisional application No. 61/676,743, filed Jul. 27, 2012, the contents of which are herein incorporated by reference.

BACKGROUND OF THE INVENTION

The present invention relates to coolers and, more particularly, to coolers that have the ability to keep objects in useable or consumable condition after leaving their primary refrigerated storage location.

Currently, coolers are not efficient at providing cooling for a long period of time. It is necessary to keep the thermal insulation, cooling source and storage compartment separated and arranged in a specific manner for it to be efficient for extended periods of time. A typical cooler will not keep the storage compartment under 60 degrees Fahrenheit, at 85 degrees Fahrenheit test temperature, for more than approximately one hour. One hour is not a significant amount of time for items that need to be kept cool for an extended period of time. Other coolers are commonly just a single piece expanded polystyrene container surrounded by an exterior shell. These coolers do not have the desired arrangement of components because there is no thermally conductive path between a cooling source and the storage compartment, providing little to no benefit.

As can be seen, there is a need for a device that may keep objects in useable or consumable condition after leaving their primary refrigerated storage location for significant amounts of time.

SUMMARY OF THE INVENTION

In one aspect of the present invention, a portable cooler device comprises an exterior shell; an insulated container having at least one hole and a top outer edge, wherein the insulated container is surrounded by the exterior shell; at least one cooling insert having an interior housing, wherein the at least one cooling insert is held by the insulated container; a liner having a top side and an internal portion that defines a cooling chamber, wherein the liner surrounds an outer surface of the interior housing of the at least one cooling insert; a cover having a bottom portion and a top portion, wherein the cover is connected to the liner and covers the cooling chamber; and a carrying handle that holds the cover in place and secured by fasteners to at least one hole in the insulated container.

In another aspect of the present invention, a portable cooler device comprises an exterior shell; an insulated container having a latch receiver, at least one hole and a top outer edge, wherein the insulated container is surrounded by the exterior shell; at least one cooling insert having an interior housing, wherein the at least one cooling insert is held by the insulated container; a liner having a top side and an internal portion that defines a cooling chamber, wherein the liner surrounds an outer surface of the interior housing of the at least one cooling insert; a cover having a bottom portion, a top portion and a cover latch, wherein the cover is connected to the liner and covers the cooling chamber; and a carrying handle that holds the cover in place and secured by fasteners to the at least one hole in the insulated container.

In yet another aspect of the present invention, a method of creating a portable cooler device comprises providing an exterior shell; providing an insulated container having at least one hole and a top outer edge, wherein the insulated container is surrounded by the exterior shell; providing at least one cooling insert having an interior housing; freezing the at least one cooling insert; placing the frozen at least one cooling insert into the insulated container; providing a liner having a top side and an internal portion comprising cooling chamber; placing the liner within the interior housing of the at least one cooling insert; providing a cover having a bottom portion and a top portion, wherein the cover is connected to the liner and covers the cooling chamber; and providing a carrying handle that holds the cover in place and is secured by fasteners to at least one hole in the insulated container.

These and other features, aspects and advantages of the present invention will become better understood with reference to the following drawings, description and claims.

BRIEF DESCRIPTION OF THE DRAWINGS

FIG. 6 is the transfer function for time, based on cooling capacity study components of the present invention.

DETAILED DESCRIPTION OF THE INVENTION

Figure 1:
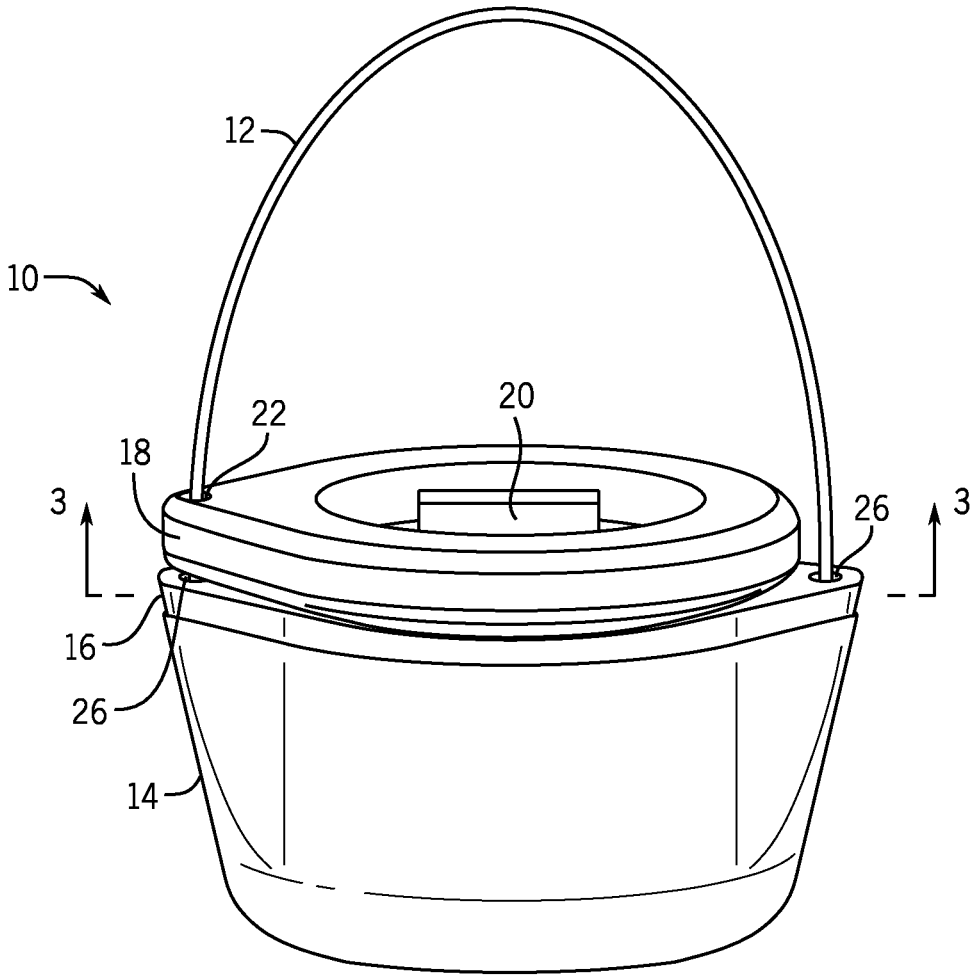
FIG. 1 is a perspective view of an exemplary embodiment of the present invention.
Figure 2:
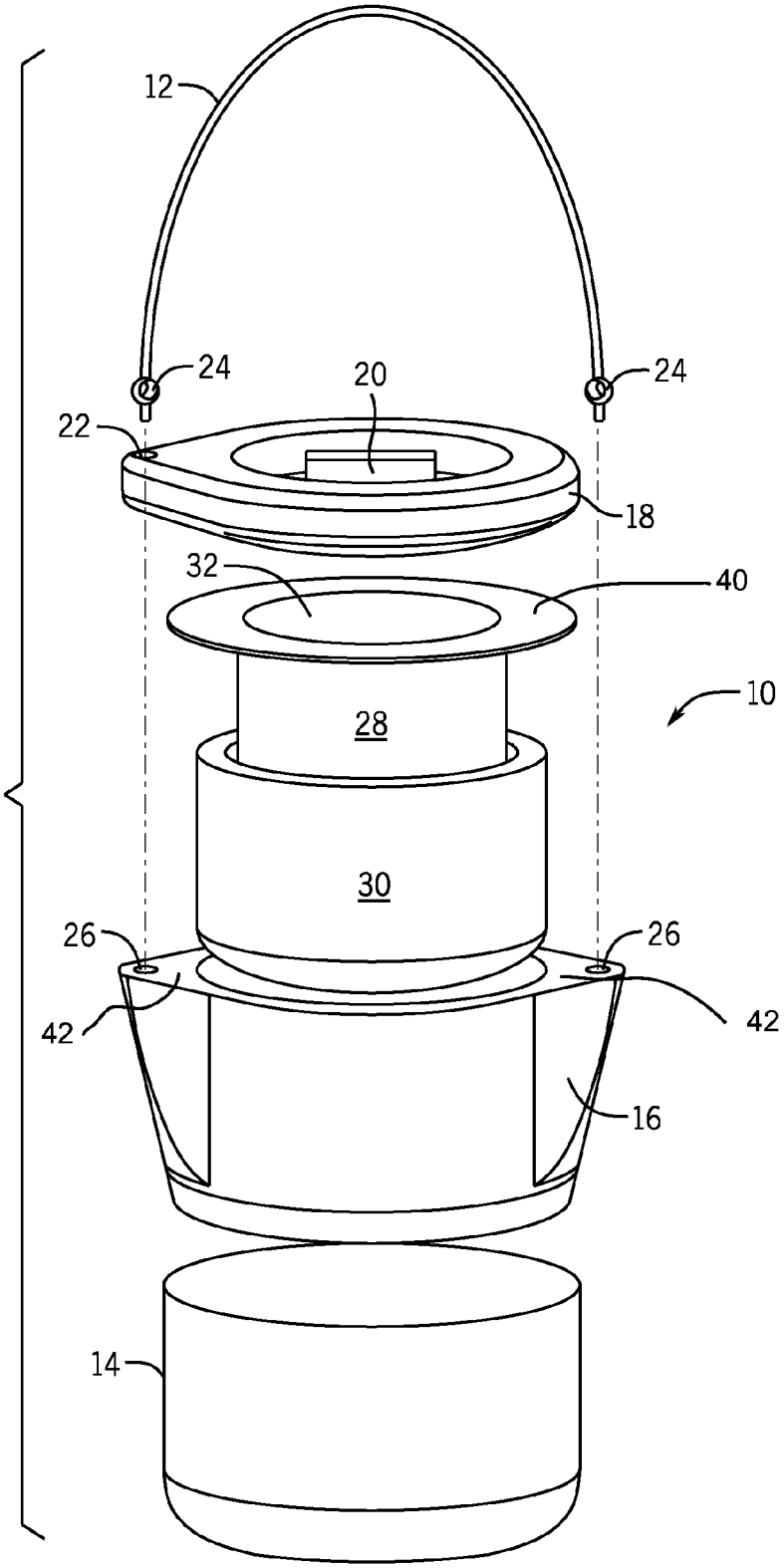
FIG. 2 is an exploded view of an exemplary embodiment of the present invention.
Figure 3:
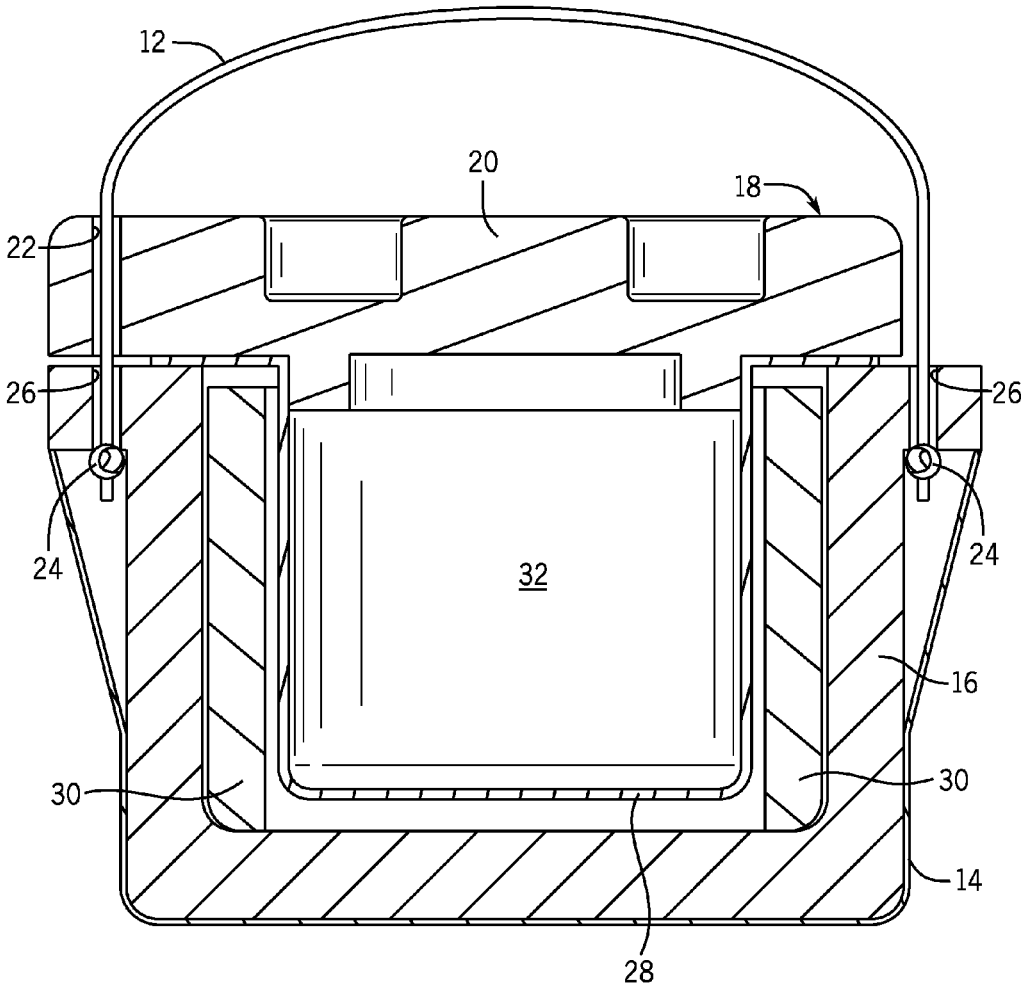
FIG. 3 is a cross-sectional view taken along line 3-3 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable cooler device. The portable cooler device may include an exterior shell, an insulated container surrounded by the exterior shell and at least one cooling insert held by the insulated container. A liner that may have a cooling chamber may surround an outer surface of the interior housing of the at least one cooling insert. A cover may be included so that the contents of the cooling chamber may stay cool. A carrying handle may hold the cover in place and allow for transport.

Referring now to FIGS. 1 through 6, a portable cooler device 10 may include an exterior shell 14. The exterior shell 14 may surround an insulated container 16. The insulated container 16 may hold at least one cooling insert 30. The at least one cooling insert 30 may have an interior housing. A liner 28 may surround an outer surface of the interior housing of the at least one cooling insert 30. The internal portion of the liner 28 may define a cooling chamber 32. Closing the top of the device may be a cover 18 which may also include a handle 20. In order to hold the device, a carrying handle 12 may be connected to the cover 18 and the insulated container 16. The carrying handle 12 may run through a hole 22 in the cover 18 and at least one hole 26 in the insulated container 16. At least one fastener 24 may be used to keep the carrying handle 12 secure.

Figure 4:
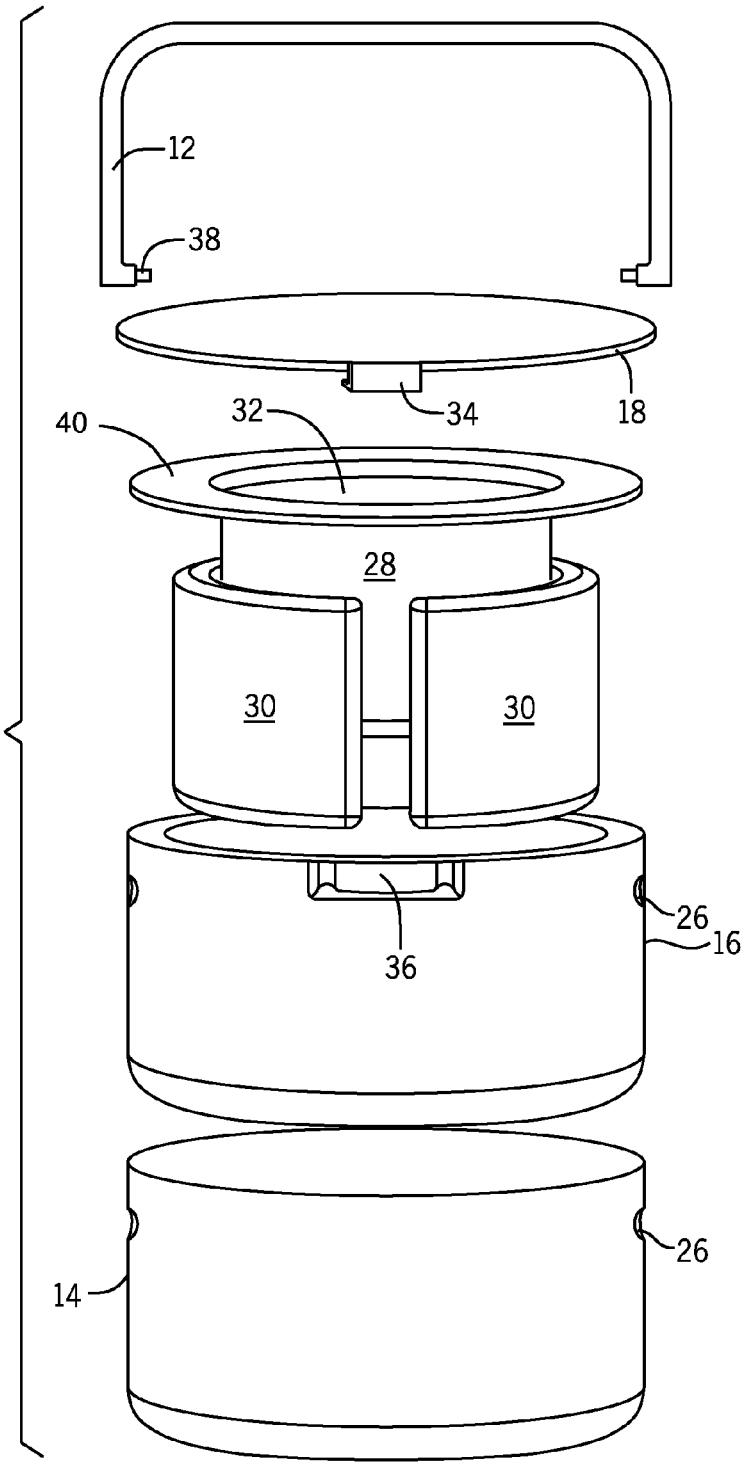
FIG. 4 is an exploded view of an alternate embodiment of the present invention.
Figure 5A:
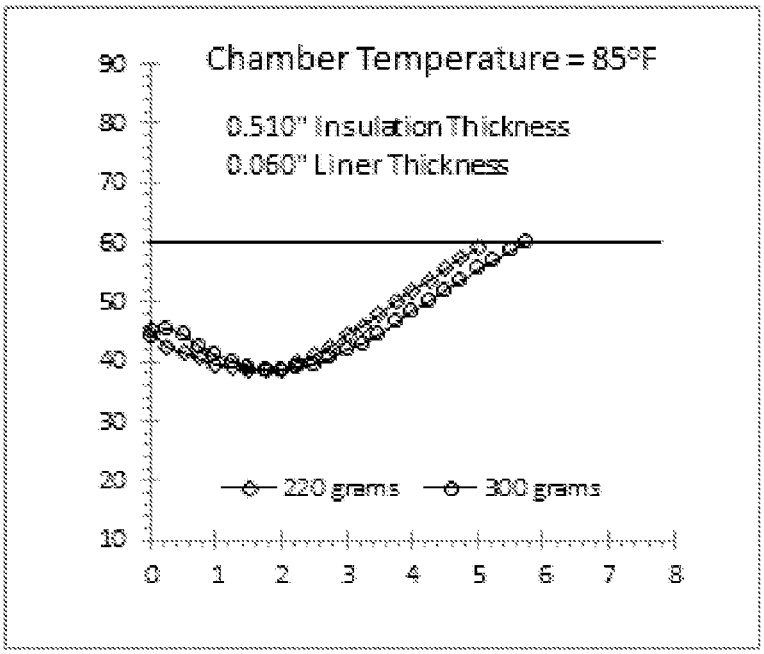
FIGS. 5A-D illustrate graphically the results of cooling capacity studies of the present invention. The factors of the study were; insulated container thickness, liner thickness, and grams of cooling insert.
Figure 5B:
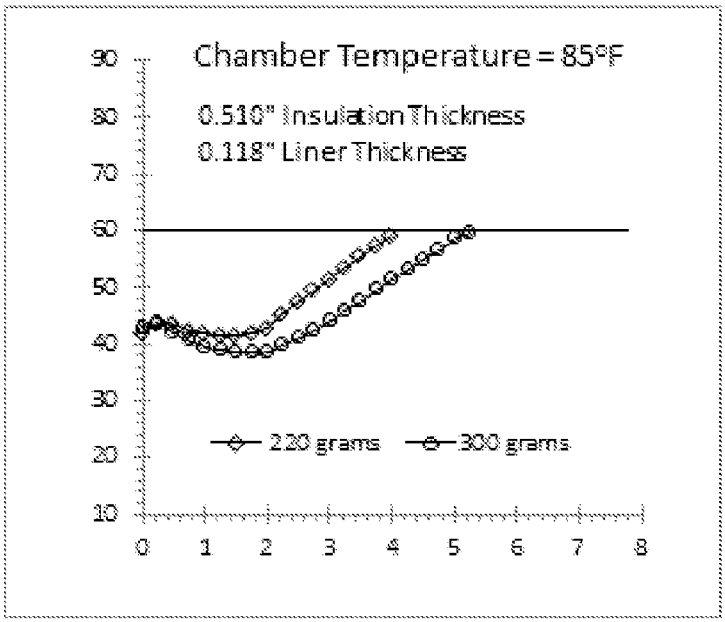
Figure 5C:
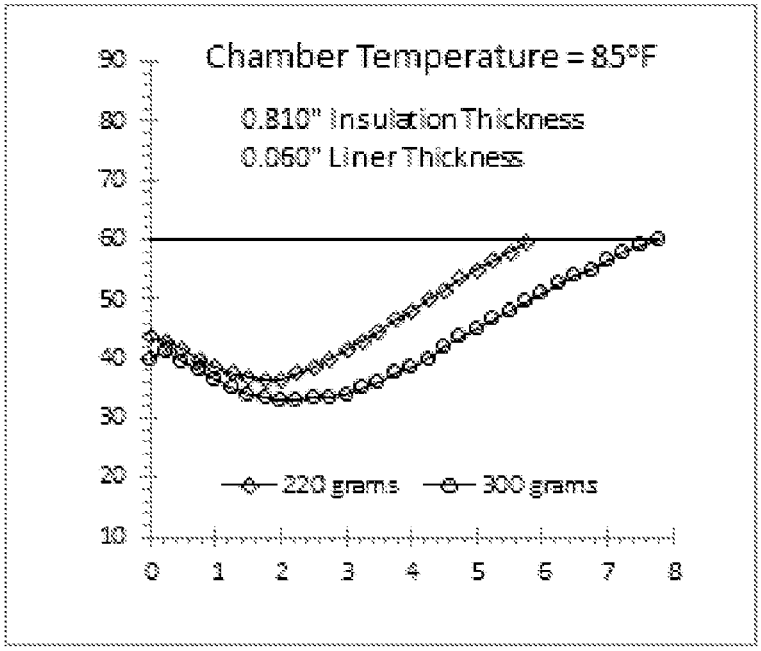
Figure 5D:
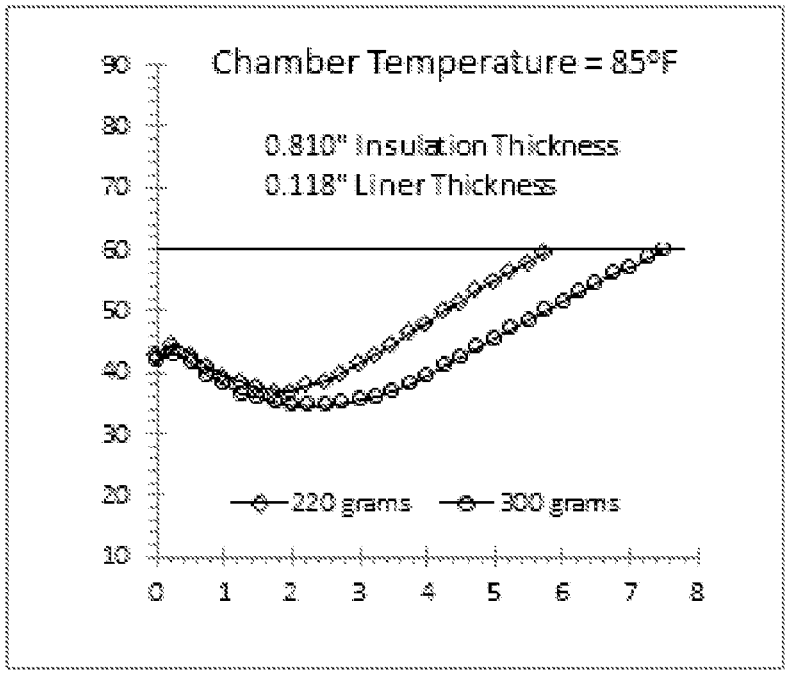

In certain embodiments as shown in FIG. 4, the device 10 may include a cover latch 34 attached to the cover 18. The cover latch 34 may be secured through a latch receiver 36 positioned along the insulated container 16. The carrying handle 12 may have at least one attachment pin 38 that may enter the at least one hole 26 in the insulated container, and at least one hole 26 in the exterior shell 14.

The exterior shell 14 may house the insulated container 16. The exterior shell 14 may provide protection from wear and tear, as well as provide space for advertising and instruction purposes along the outside portion of the exterior shell 14. Placed inside of the exterior shell 14 may be the insulated container 16. The insulated container 16 has a top outer edge. The insulated container 16 may provide a rigid exterior for the device 10 and also may provide insulation between the exterior of the device 10 and the at least one cooling insert 30. The insulated container 16 may have at least one extended portion 42 that may provide an extended lip for the top outer edge of the insulated container 16 and may have at least one hole 26 in the insulated container.

The at least one cooling insert 30 may effectively keep the contents of the cooling chamber 32 cool and fresh longer than ice, without the watery mess. The at least one cooling insert may be made from a polymer gel formation or gel pack and the like. The at least one cooling insert 30 also may provide thermodynamic heat transfer that enables cooling the inside of the cooling chamber 32 lower than 60 degrees Fahrenheit for up to eight hours with an outside temperature of 85 degrees Fahrenheit. The at least one cooling insert 30 may have an interior housing. The liner 28 may be positioned so that the liner 28 surrounds an outer surface of the interior housing of the at least one cooling insert 30. The liner 28 may separate the at least one cooling insert 30 from the contents within the cooling chamber 32. The liner 28 may control the heat transfer process between the contents of the cooling chamber 32 and the at least one cooling insert 30. The liner 28 may be removable so that the liner 28 may be easily cleaned. In certain embodiments, the liner 28 also may include a cutting surface 40 so that in certain instances, such as fishing and the like, preparation may be carried on in order for the bait to be ready to being placed on a line. The cutting surface 40 may be along the top side of the liner 28. As is mentioned above, the contents of the present device 10 may be within the cooling chamber 32.

In order to keep the temperature low within the cooling chamber 32, a cover 18 may be used. The cover 18 may enclose any open faced portions of the present device 10. The cover 18 provides an insulated cover to help keep the cooling chamber 32 cool. The cover 18 keeps the contents of the cooling chamber 32 within the cooling chamber 32. Along the bottom portion of the cover 18 may be lid flange that may allow the cover 18 to maintain a concentric fit between the cover 18 and the liner 28. Along the outside portion of the cover 18 may be an external shell that may provide abrasion protection along with the required thermal properties. The cover 18 may be held in place by the carrying handle 12. The carrying handle 12 may be used to transport the present device 10. The cover 18 may be connected to the insulated container 16 by the carrying handle 12 in certain embodiments, or by the cover 18 alone in other embodiments. The carrying handle 12 may connect through a hole in the cover 22 and at least one hole 26 in the insulated container that may be located on at least one extended portion 42 that may provide an extended lip for the top outer edge of the insulated container 16. The cover 18 may be easily removed from the rest of the present device by a centrally located handle 20. At least one fastener 24 may be positioned below the at least one hole 26 in the insulated container so that the carrying handle 12 may be secured in place.

A method of using a portable cooler device may include the following. Place the at least one cooling insert into a freezer until it is completely frozen. The polymer gel formation may freeze at a temperature set within a freezer. Once the at least one cooling insert is frozen, place it inside of the insulated container. Place the liner inside of the at least one cooling insert and the position any object that needs to be cooled inside of the cooling chamber. Once the object or objects are positioned within the cooling chamber, cover the present device with the cover. The present device may be used to store items that may need to be cooled for an extended time without power, which may include objects such as edible items, medication and the like. The size of the portable cooler may be adjusted as long as the present device still maintains effective cooling for objects. The insulated container may be made from Styrofoam and the like.

It should be understood, of course, that the foregoing relates to exemplary embodiments of the invention and that modifications may be made without departing from the spirit and scope of the invention as set forth in the following claims.

What is claimed is:

1. A portable cooler device comprising:

an exterior shell;

an insulated container having a top outer edge and an inner perimeter, wherein the insulated container is surrounded by the exterior shell;

a cooling insert having an interior housing, wherein the cooling insert is held by the insulated container, wherein the cooling insert conforms to a substantial portion of the inner perimeter of the insulated container;

a liner having a top side and an internal portion comprising a cooling chamber, wherein the liner is placed within the interior housing of the at least one cooling insert; and a cover having a bottom portion and a top portion, wherein the cover removably covers the cooling chamber.

2. The portable cooler device of claim 1, wherein the exterior shell has at least one hole and the insulated container has at least one hole aligning with the at least one hole of the exterior shell.

3. The portable cooler device of claim 1, wherein the top side of the liner has a cutting surface.

4. A method for keeping items cooled within a cooler comprising the steps of:

placing the items within a cooling chamber of the cooler, wherein the cooler comprises:

an exterior shell;

a rigid insulated container comprising an inner perimeter and disposed within the exterior shell;

at least one pre-cooled cooling insert disposed within the rigid insulated container, wherein the at least one pre-cooled cooling insert comprises an elliptical cylinder shape and conforms to a substantial portion of the inner perimeter of the rigid insulated container, wherein the pre-cooled cooling insert forms an interior housing;

and a liner disposed within the interior housing, wherein the liner forms the cooling chamber; and placing a cover over the cooling chamber.

5. The portable cooler device of claim 2, further comprising a carrying handle, the carrying handle being secured by a fastener within the at least one hole of the insulated container and the at least one hole of the exterior shell.

6. The portable cooler device of claim 1, wherein the insulated container further comprises a latch receiver.

7. The portable cooler device of claim 1, wherein the at least one cooling insert comprises an elliptical cylinder shape.

8. The portable cooler device of claim 6, wherein the cover further comprises a cover latch, wherein the cover latch removably connects to the latch receiver positioned along the insulated container.

9. The portable cooler device of claim 1, wherein the cover comprises at least one hole and the shell comprises at least one hole, wherein the at least one hole of the cover aligns with the at least one hole of the shell.

10. The portable cooler device of claim 9, further comprising a handle wherein the handle runs through the at least one hole of the cover and the at least one hole of the shell.

11. The portable cooler device of claim 10, wherein the handle further comprises a fastener securing the handle within the at least one hole of the cover and the at least one hole of the shell.

* * * * *